US008960270B2

(12) United States Patent
Sevre et al.

(10) Patent No.: US 8,960,270 B2
(45) **Date of Patent: *Feb. 24, 2015**

(54) SHUNT TUBE FLOWPATHS EXTENDING THROUGH SWELLABLE PACKERS

(75) Inventors: Alf K. Sevre, Houston, TX (US); Tom R. Koloy, Sandnes (NO); Alan Wilkins, The Woodlands, TX (US); Rutger Evers, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 570 days.

This patent is subject to a terminal disclaimer.

(21) Appl. No.: 12/780,148

(22) Filed: May 14, 2010

(65) Prior Publication Data

US 2010/0236775 A1 Sep. 23, 2010

Related U.S. Application Data

(63) Continuation of application No. 12/256,063, filed on Oct. 22, 2008, now Pat. No. 7,784,532.

(51) Int. Cl.

| | |
|---|---|
| ***E21B 33/12*** | (2006.01) |
| ***E21B 43/04*** | (2006.01) |
| ***E21B 23/04*** | (2006.01) |
| ***E21B 34/08*** | (2006.01) |
| *E21B 34/00* | (2006.01) |

(52) U.S. Cl.

CPC ..... *E21B 43/04* (2013.01); *E21B 23/04* (2013.01); *E21B 33/1208* (2013.01); *E21B 34/08* (2013.01); *E21B 2034/005* (2013.01)

USPC ..... 166/51; 166/188

(58) Field of Classification Search

USPC ..... 166/241.7, 118, 180, 183, 206

See application file for complete search history.

(56) References Cited

U.S. PATENT DOCUMENTS 3,109,450 A * 11/1963 Hardeastle ..... 137/514
5,472,054 A * 12/1995 Hinds ..... 166/373

(Continued)

FOREIGN PATENT DOCUMENTS

WO 2007092082 A2 8/2007
WO 2007126496 A2 11/2007

(Continued)

OTHER PUBLICATIONS

International Search Report and Written Opinion issued Nov. 24, 2009, for International Patent Application Serial No. PCT/US09/61148, 7 pages.

(Continued)

*Primary Examiner* — James G Sayre
(74) *Attorney, Agent, or Firm* — Smith IP Services, P.C.

(57) ABSTRACT

Shunt tube flowpaths extending through swellable packers. A well system includes a packer assembly including a base pipe and an annular seal element which is swellable in response to contact with a selected fluid, and a shunt tube flowpath extending through the seal element for delivery of a slurry in a gravel packing operation. A swellable packer assembly includes a base pipe; a swellable annular seal element having a shunt tube flowpath extending through a swellable material; and a valve connected to the flowpath and positioned within the swellable material. Another well system comprises a packer assembly including a base pipe and an annular seal element which is swellable in response to contact with a selected fluid; a shunt tube flowpath extending through a swellable material of the seal element; and a connection between the flowpath and a shunt tube assembly, the connection being positioned within the swellable material.

10 Claims, 7 Drawing Sheets

(56) References Cited

U.S. PATENT DOCUMENTS

| | | | | |
|---|---|---|---|---|
| 5,584,315 | A * | 12/1996 | Powell | 137/15.18 |
| 7,143,832 | B2 | 12/2006 | Freyer | |
| 7,407,007 | B2 * | 8/2008 | Tibbles | 166/278 |
| 7,562,709 | B2 * | 7/2009 | Saebi et al. | 166/278 |
| 2002/0174984 | A1 * | 11/2002 | Jones | 166/278 |
| 2002/0189821 | A1 * | 12/2002 | Watson et al. | 166/387 |
| 2007/0044962 | A1 * | 3/2007 | Tibbles | 166/278 |
| 2008/0277109 | A1 | 11/2008 | Vaidya | |
| 2009/0008084 | A1 | 1/2009 | Dybevik et al. | |
| 2010/0096119 | A1 | 4/2010 | Sevre et al. | |
| 2010/0230902 | A1 | 9/2010 | Castillo et al. | |

FOREIGN PATENT DOCUMENTS

| | | | |
|---|---|---|---|
| WO | 2008008687 | A1 | 1/2008 |
| WO | 2008036553 | A2 | 3/2008 |

OTHER PUBLICATIONS

Office Action issued Sep. 9, 2009 for U.S. Appl. No. 12/256,063, 13 pages.

Office Action issued Feb. 17, 2010 for U.S. Appl. No. 12/256,063, 8 pages.

Australian Office Action issued Feb. 17, 2010 for AU Patent Application No. 2009307807, 4 pages.

E-Bay Product advertisement, Cowl Vent Drain Hose, Dec. 21, 2008, 3 pages.

International Search Report and Written Opinion issued Nov. 24, 2009 for PCT Patent Application No. PCT/US09/61148, 7 pages.

International Preliminary Report on Patentability issued May 5, 2011, for International Patent Application No. PCT/US09/061148, 6 pages.

Examination Report issued Mar. 20, 2013 for Australian Patent Application No. 2009307807, 3 pages.

* cited by examiner

SHUNT TUBE FLOWPATHS EXTENDING THROUGH SWELLABLE PACKERS

CROSS-REFERENCE TO RELATED APPLICATION

The present application is a continuation of U.S. application Ser. No. 12/256,063 filed on Oct. 22, 2008 now U.S. Pat. No. 7,784,532. The entire disclosure of this prior application is incorporated herein by this reference.

BACKGROUND

The present disclosure relates generally to equipment utilized and operations performed in conjunction with a subterranean well and, in an embodiment described herein, more particularly provides for shunt tube flowpaths extending through swellable packers.

Shunt tubes are used in gravel packing operations to facilitate even distribution of gravel in an annulus between well screens and a wellbore. In some circumstances, it is desirable to close off the annulus between well screens after the gravel packing operation (for example, to provide isolation between gravel packed zones).

Packers can be used to close off the annulus between well screens, but certain problems must be overcome in order to utilize such packers and shunt tubes in a single trip multi-zone gravel packing operation. For example, communication should be provided between shunt tubes on opposite sides of a packer, and this communication should be ceased after the gravel packing operation is completed, in order to provide for isolation between the opposite sides of the packer.

The use of valves made of swellable material and positioned within the shunt tubes on opposite sides of a packer has been proposed. However, such valves restrict flow through the shunt tubes. It has also been proposed to extend the shunt tubes through the interior of a base pipe of the packer, but this restricts flow and access through the interior of the base pipe.

Therefore, it may be seen that improvements are needed in the art of extending shunt tube flowpaths through packers and controlling flow through the flowpaths.

SUMMARY

In the present specification, packer assemblies and well systems are provided which solve at least one problem in the art. One example is described below in which a shunt tube flowpath extends through a swellable material of a seal element on a packer assembly. Another example is described below in which one or more valves, connections, etc. are positioned within the swellable material.

In one aspect, a well system is provided which includes a packer assembly including a base pipe and an annular seal element which is swellable in response to contact with a selected fluid. A shunt tube flowpath extends through the seal element radially between the base pipe and a wellbore for delivery of a slurry in a gravel packing operation.

In another aspect, a swellable packer assembly is provided. The packer assembly includes a generally tubular base pipe and a swellable annular seal element having a shunt tube flowpath extending through a swellable material of the seal element. At least one valve is connected to the flowpath, with the valve being positioned within the swellable material of the seal element.

In yet another aspect, a well system includes a packer assembly with a base pipe and an annular seal element which is swellable in response to contact with a selected fluid. A shunt tube flowpath extends through a swellable material of the seal element. A connection between the flowpath and a shunt tube assembly is positioned within the swellable material of the seal element radially between the base pipe and a wellbore.

In a further aspect, a well system includes a well tool, a shunt tube flowpath extending longitudinally through the well tool, and at least one check valve permitting flow through the flowpath in one direction, but preventing flow through the flowpath in an opposite direction.

These and other features, advantages and benefits will become apparent to one of ordinary skill in the art upon careful consideration of the detailed description of representative embodiments below and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
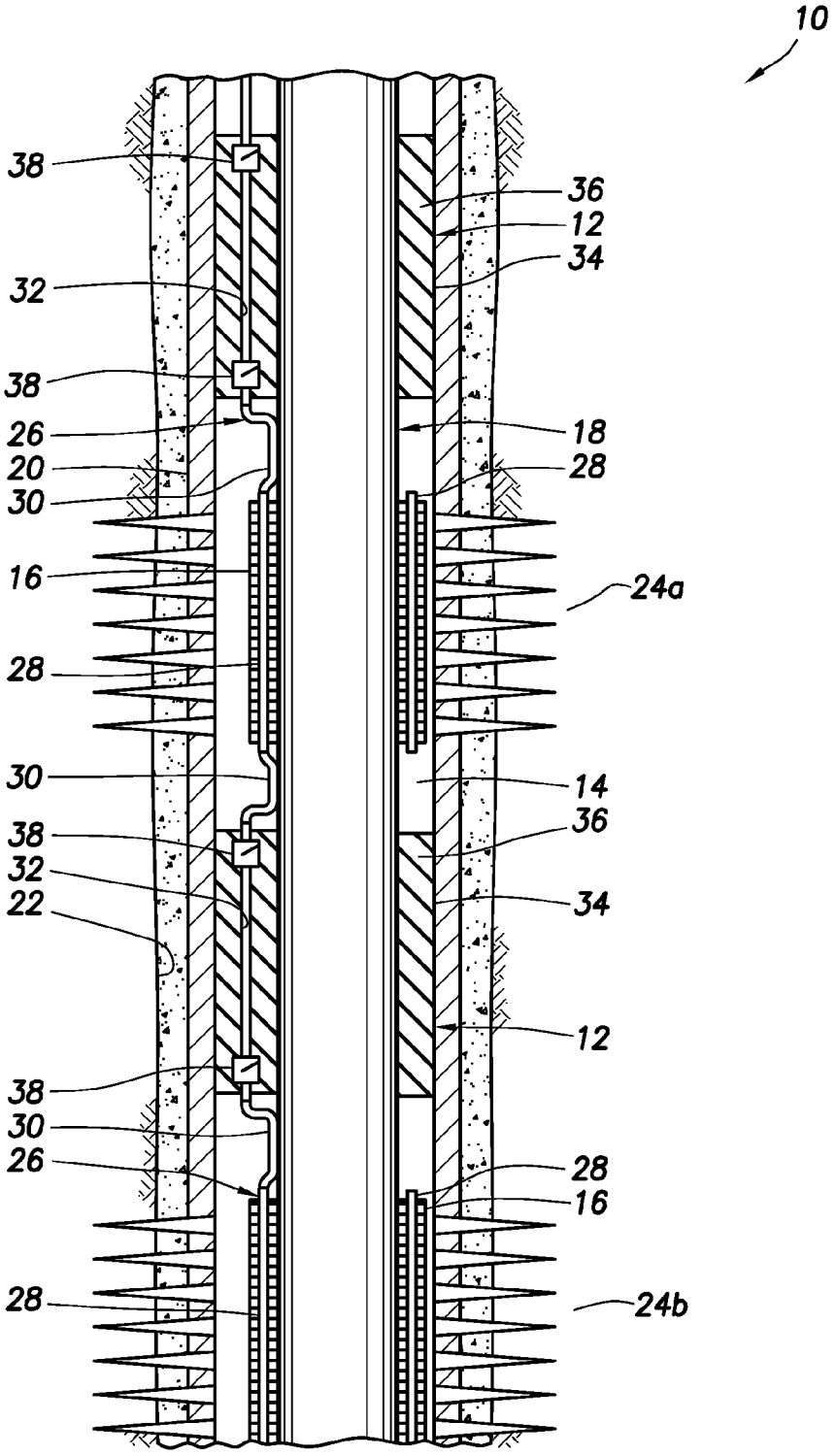
FIG. 1 is a schematic partially cross-sectional view of a well system embodying principles of the present disclosure.

Representatively illustrated in FIG. 1 is a well system 10 which embodies principles of the present disclosure. In the well system 10, swellable packer assemblies 12 are used to close off an annulus 14 longitudinally between well screens 16.

The annulus 14 is formed radially between a tubular string 18 and casing 20 lining a wellbore 22. However, if the wellbore 22 were uncased or open hole, then the annulus would be formed between the tubular string 18 and the wellbore 22.

Although two well screens 16 and two packer assemblies 12 are depicted in FIG. 1 for producing from and isolating two formation zones 24*a,b* intersected by the wellbore 22, it should be understood that any number and any combination of screens, packers and zones may be present in a well system embodying principles of this disclosure, any number of screens may be positioned between a pair of packer assemblies, and any configuration of these components and the overall system may be used. The principles of this disclosure are not limited in any way to the particular details of the well system 10, packer assemblies 12 and screens 16 depicted in FIG. 1.

Shunt tube assemblies 26 provide for even distribution of gravel when a gravel packing operation is performed. The shunt tube assemblies 26 as depicted in FIG. 1 include shunt tubes 28 extending along the screens 16, and jumper tubes 30 interconnecting the shunt tubes to flowpaths 32 extending through the packer assemblies 12.

Multiple shunt tubes 28 may extend along the screens 16, and any number or combination of the shunt tubes may be in fluid communication with the annulus 14 on either side of the screens. The shunt tubes 28 depicted in FIG. 1 extend longitudinally through a filter portion of each screen 16, but the shunt tubes could instead, or in addition, extend external or internal to the screens and in any position relative to the filter portion or an external shroud of the screen, as desired.

The shunt tube flowpath 32 extends longitudinally through a swellable seal element 34 of each packer assembly 12. During the gravel packing operation, the packer assemblies 12 are preferably not sealingly engaged with the casing 20, and a gravel slurry is permitted to flow through the flowpaths 32 to facilitate even distribution of the slurry in the annulus 14. Upon contact with a selected fluid, however, a swellable material 36 of the seal element 34 swells, so that the seal element extends radially outward and sealingly engages the casing 20, thereby closing off the annulus 14 on either side of the screens 16.

The term "swell" and similar terms (such as "swellable") are used herein to indicate an increase in volume of a material. Typically, this increase in volume is due to incorporation of molecular components of the fluid into the swellable material itself, but other swelling mechanisms or techniques may be used, if desired. Note that swelling is not the same as expanding, although a material may expand as a result of swelling.

For example, in some conventional packers, a seal element may be expanded radially outward by longitudinally compressing the seal element, or by inflating the seal element. In each of these cases, the seal element is expanded without any increase in volume of the material of which the seal element is made. Thus, in these conventional packers, the seal element expands, but does not swell.

The fluid which causes swelling of the swellable material 36 could be water and/or hydrocarbon fluid (such as oil or gas). The fluid could be a gel or a semi-solid material, such as a hydrocarbon-containing wax or paraffin which melts when exposed to increased temperature in a wellbore. In this manner, swelling of the material 36 could be delayed until the material is positioned downhole where a predetermined elevated temperature exists.

The fluid could cause swelling of the swellable material 36 due to passage of time. The fluid which causes swelling of the material 36 could be naturally present in the well, or it could be conveyed with the packer assembly 12, conveyed separately or flowed into contact with the material 36 in the well when desired. Any manner of contacting the fluid with the material 36 may be used in keeping with the principles of the present disclosure.

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-0020662, the entire disclosures of which are incorporated herein by this reference.

The swellable material 36 may have a considerable portion of cavities which are compressed or collapsed at the surface condition. Then, when being placed in the well at a higher pressure, the material 36 is expanded by the cavities filling with fluid.

This type of apparatus and method might be used where it is desired to expand the material 36 in the presence of gas rather than oil or water. A suitable swellable material is described in International Application No. PCT/NO2005/000170 (published as WO 2005/116394), the entire disclosure of which is incorporated herein by this reference.

Preferably, the swellable material 36 used in the seal element 34 swells by diffusion of hydrocarbons into the swellable material, or in the case of a water swellable material, by the water being absorbed by a super-absorbent material (such as cellulose, clay, etc.). Hydrocarbon-, water- and gas-swellable materials may be combined in the seal element 34, if desired.

It should, thus, be clearly understood that any type or combination of swellable material which swells when contacted by any type of fluid may be used in keeping with the principles of this disclosure. Swelling of the material 36 may be initiated at any time, but preferably the material swells at least after the packer assembly 12 is installed in the well.

Swelling of the material 36 may be delayed, if desired. For example, a membrane or coating may be on any or all surfaces of the material 36 to thereby delay swelling of the material. The membrane or coating could have a slower rate of swelling, or a slower rate of diffusion of fluid, in order to delay swelling of the material 36. The membrane or coating could have delayed permeability or could break down in response to exposure to certain amounts of time and/or certain temperatures. Suitable techniques and arrangements for delaying swelling of a swellable material are described in U.S. Pat. No. 7,143,832 and in U.S. Published Application No. 2008-0011473, the entire disclosures of which are incorporated herein by this reference.

When the gravel packing operation is concluded, it is desirable for fluid communication through the flowpath 32 to be prevented, to provide complete isolation between the opposite sides of the packer assemblies 12. For this purpose, the packer assemblies 12 may include one or more valves 38. The valves 38 may comprise one-way or check valves, or selectively closeable valves, as described more fully below.

Figure 2:
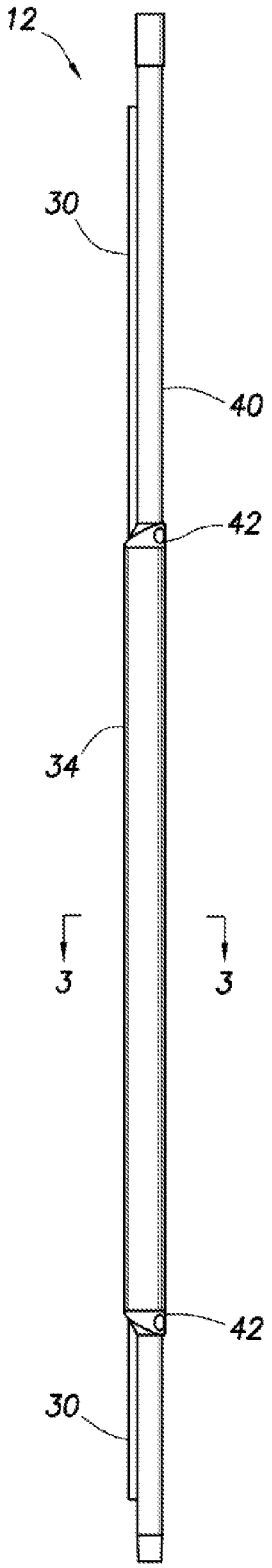
FIG. 2 is a somewhat enlarged scale elevational view of a packer assembly usable in the well system of FIG. 1, the packer assembly embodying principles of the present invention.

A more detailed elevational view of the packer assembly 12 is representatively illustrated in FIG. 2. In this view, it may be seen that the packer assembly 12 preferably includes the seal element 34 attached externally to a generally tubular base pipe 40. End rings 42 secure the seal element 34 against longitudinal displacement relative to the base pipe 40.

In this example, the seal element 34 is bonded and/or molded onto the base pipe 40, and the end rings 42 are welded to the base pipe, to thereby form a unitary construction. However, in other examples, the seal element 34 may not be bonded to the base pipe 40 and the end rings 42 may be clamped or otherwise secured to the base pipe, in order to provide for adjustment of the rotational alignment of these components at the time of installation, as described more fully below in conjunction with the description of FIGS. 5 & 6.

Figure 3:
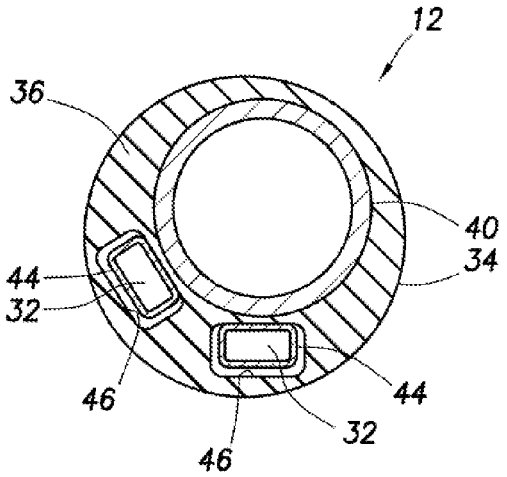
FIG. 3 is an enlarged scale lateral cross-sectional view of the packer assembly.

A lateral cross-sectional view of the packer assembly 12, taken through the seal element 34, is representatively illustrated in FIG. 3. In this view, it may be seen that two of the flowpaths 32 extend through the seal element 34 radially between inner and outer surfaces of the seal element. To accommodate the flowpaths 32, the seal element 34 is laterally offset relative to the base pipe 40.

In addition, the flowpaths 32 extend through tubular elements 44 positioned in longitudinally extending cavities 46 formed through the seal element 34. As depicted in FIG. 3, the cavities 46 may be somewhat larger than the tubular elements 44, but as the material 36 swells, it will close around and seal against the tubular elements. Alternatively, the cavities 46 may be closely fitted about the tubular elements 44 (e.g., the tubular elements could be bonded or molded within the cavities) prior to the material 36 swelling, if desired.

Although the tubular elements 44 and cavities 46 have a rounded rectangular configuration as depicted in FIG. 3, any shape may be utilized (e.g., square, circular, oval, etc.), as desired. Any number and combination of flowpaths 32, tubular elements 44 and cavities 46 may be used in keeping with the principles of this disclosure.

Figure 4:
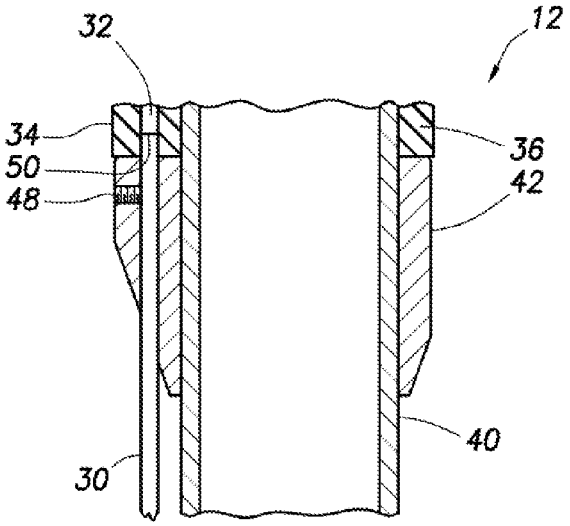
FIG. 4 is a partial longitudinal cross-sectional view of the packer assembly.

A longitudinal cross-sectional view of the packer assembly 12, taken through the lower end ring 42, is representatively illustrated in FIG. 4. In this view, the jumper tube 30 extends through the end ring 42 and is secured with a set screw 48. The jumper tube 30 also extends into the seal element 34, and a connection 50 is thereby made between the flowpath 32 and the jumper tube within the seal element.

The positioning of the connection 50 within the seal element 34 is a very beneficial feature of the packer assembly 12 example of FIGS. 2-4. In this manner, the connection 50 is not exposed to the annulus 14 (thus avoiding leakage between the flowpath 32 and the annulus), and when the material 36 swells it will reinforce the sealed connection between the flowpath and the jumper tube 30.

Figure 5:
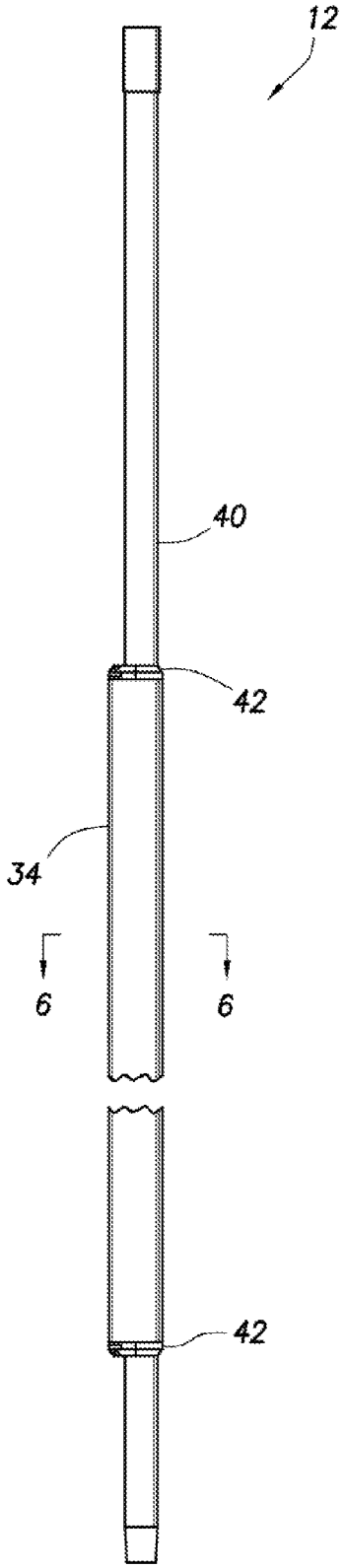
FIG. 5 is an elevational view of another configuration of the packer assembly.
Figure 6:
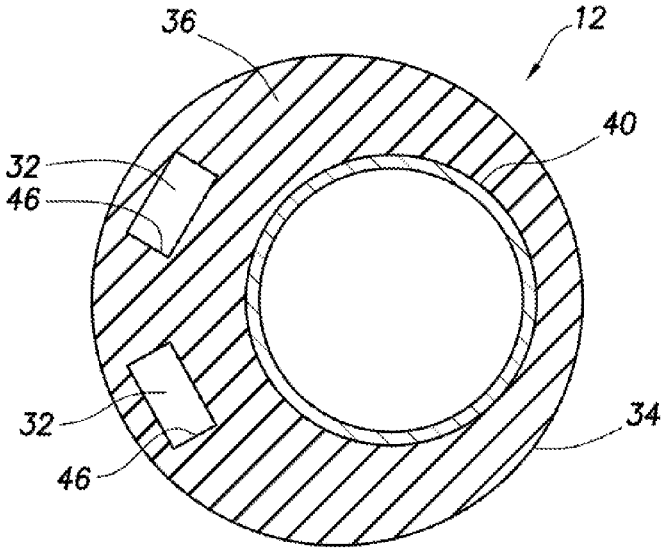
FIG. 6 is an enlarged scale lateral cross-sectional view of the packer assembly of FIG. 5.

Another configuration of the packer assembly 12 is representatively illustrated in FIGS. 5 & 6. In this configuration, the flowpaths 32 do not extend through tubular elements 44. Instead, the flowpaths 32 are in direct contact with the swellable material 36 between inner and outer surfaces of the seal element 34.

In addition, the end rings 42 are clamped onto the base pipe 40 and the seal element 34 is not bonded to the base pipe. In this manner, the cavities 46 and end rings 42 can be rotationally aligned with the jumper tube 30 (and/or any other portion of the shunt tube assemblies 26) when the packer assembly 12 is installed, without any need to time or otherwise rotationally align threaded end connections on the base pipe 40.

Figure 7:
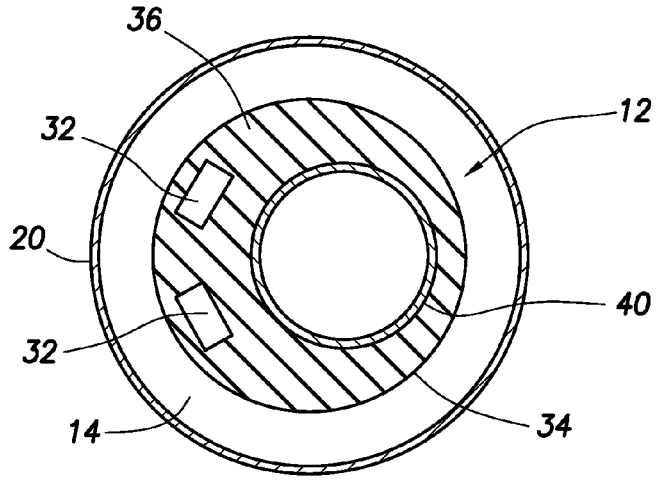
FIGS. 7-9 are schematic cross-sectional views of successive steps in which shunt tube flowpaths in the packer assembly of FIG. 6 are closed off.
Figure 8:
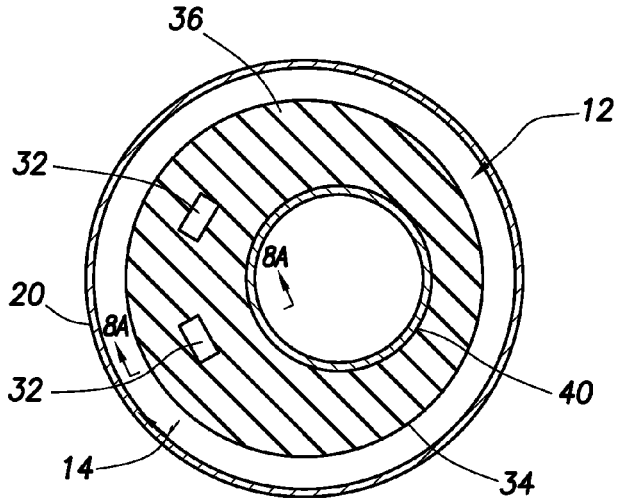
Figure 9:
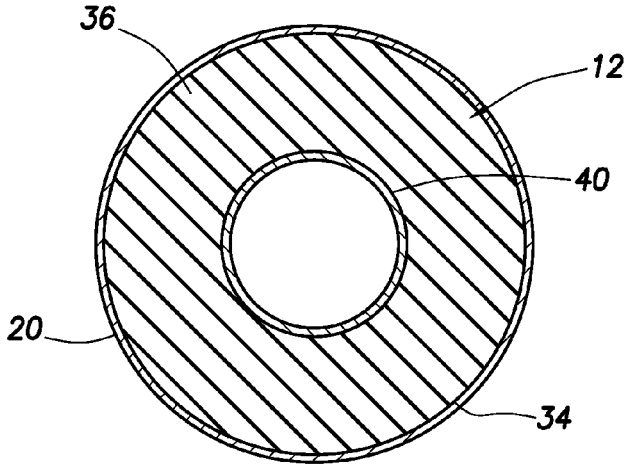

In FIGS. 7-9, a succession of steps in setting the packer assembly 12 in the casing 20 and closing off the flowpaths 32 are representatively illustrated. As discussed above, the packer assembly 12 could be set in an uncased open hole if desired.

In FIG. 7, the packer assembly 12 is unset. In this configuration, the annulus 14 may be gravel packed about the screens 16 as discussed above. A gravel slurry can flow through the shunt tube flowpaths 32 in the seal element 34 between opposite sides of the packer assembly 12.

In FIG. 8, the swellable material 36 has been exposed to the selected fluid which causes the material to swell. As a result, the seal element 34 has swollen somewhat, the annulus 14 is partially closed off, and the flowpaths 32 are partially closed off. However, swelling of the swellable material 36 could be delayed, if desired, using the techniques and arrangements discussed above and/or described in the incorporated documents. In this manner, closing off of the annulus 14 and/or closing off of the flowpaths 32 may be delayed.

Figure 8A:
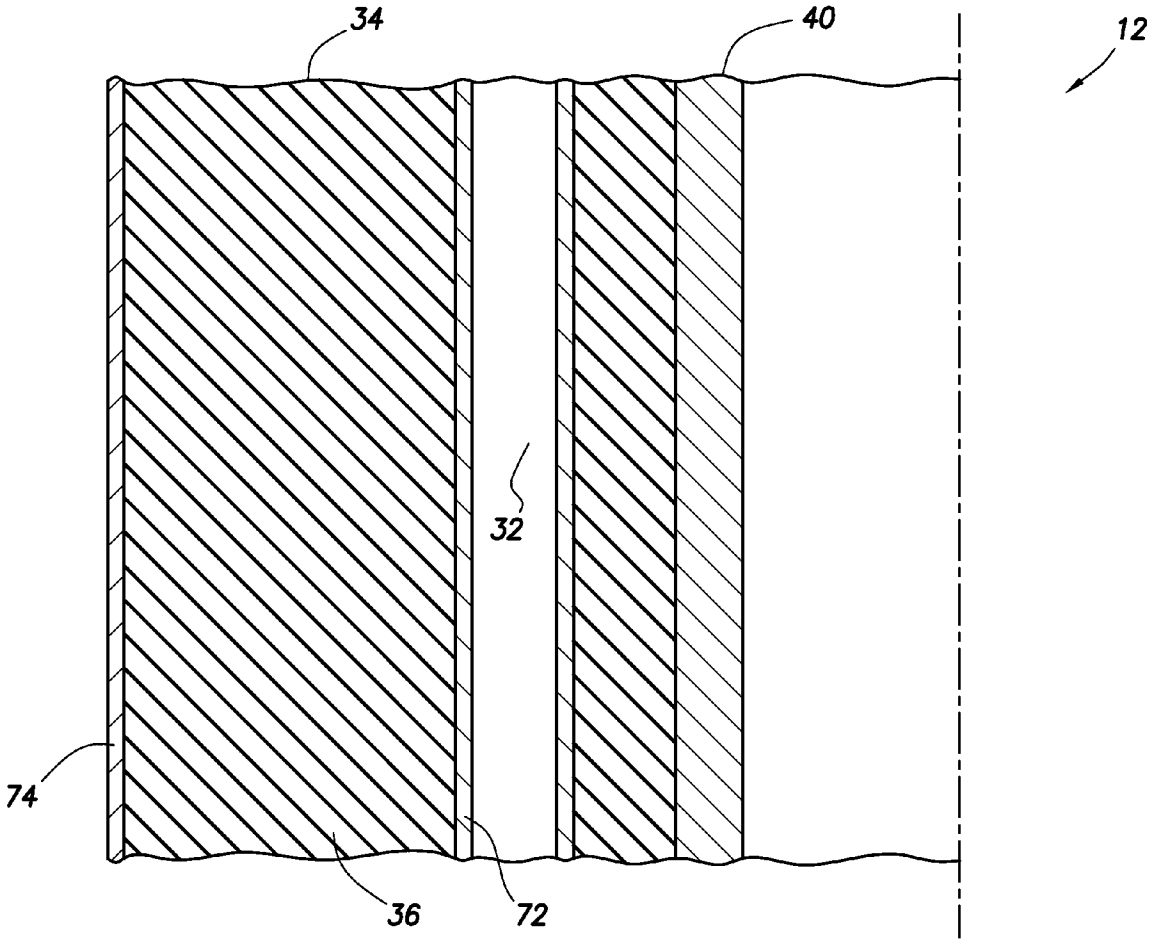

In the example depicted in FIG. 8A, an interior surface of the flowpath 32 is lined with a swell delaying material 72, and an exterior surface of the seal element 34 is lined with a swell delaying material 74. The materials 72, 74 may be of the same type, or they may be different (for example, to alter the relative occurrences of closing off the annulus 14 and closing off the flowpath 32). Preferably, the materials 72, 74 are selected so that the annulus 14 is closed off by the seal element 34 prior to the flowpath 32 being closed off, but these occurrences could be simultaneous or in any other order, as desired.

In FIG. 9, the packer assembly 12 is fully set. The seal element 34 has swollen sufficiently to completely close off the annulus 14 and flowpaths 32. This provides complete fluid isolation between the zones 24*a,b* in the annulus 14.

By using the techniques and arrangements discussed above and/or described in the incorporated documents, the annulus 14 could be closed off prior to the flowpaths 32 (or either of them) being closed off by delaying swelling of the material 36 about the flowpaths (or either of them), or the flowpaths (or either of them) could be closed off prior to the annulus being closed off by delaying swelling of the material on an exterior surface of the seal element 34. In one embodiment, swelling of the material 36 may be delayed to a greater extent at the flowpaths 32 as compared to at the outer margin of the seal element, so that the annulus 14 is closed off prior to the flowpaths 32 being closed off.

When using the packer assembly 12 configuration of FIGS. 5-9, a separate valve 38 is not needed for selectively preventing flow through the flowpath 32. However, in FIGS. 10-12, enlarged scale cross-sectional views of examples of valves 38 suitable for use in the packer assembly 12 configuration of FIGS. 2-4 are representatively illustrated.

Figure 10:
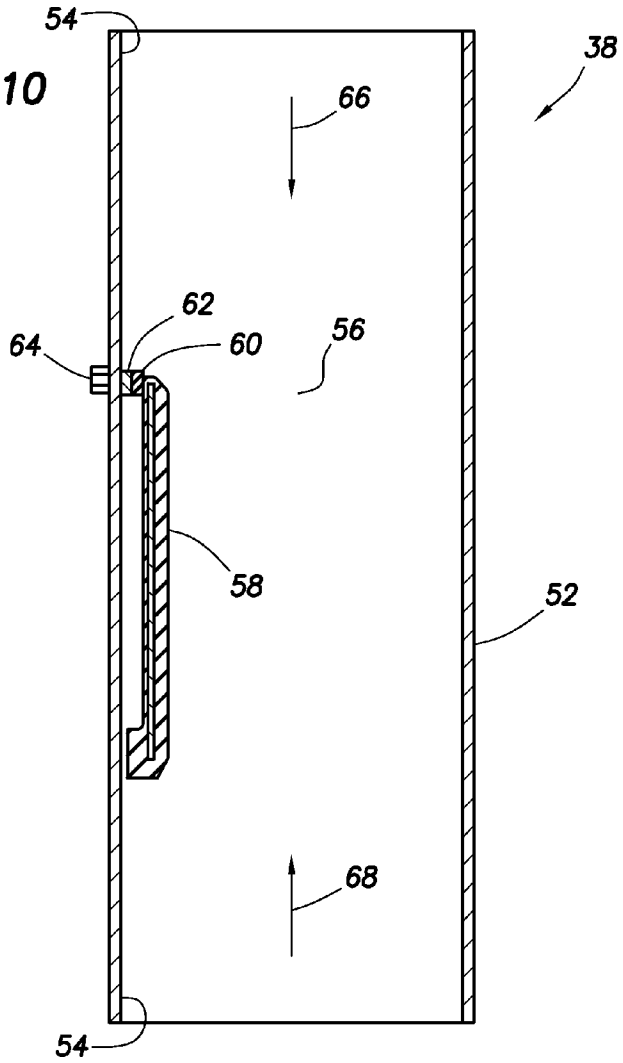

In FIG. 10, the valve 38 includes a generally tubular body 52 which is proportioned to connect to the tubular element 44 at one or both ends. For example, the body 52 may have a rounded rectangular lateral cross-sectional shape to conform to the shape of the tubular element 44 depicted in FIG. 3, and end connections 54 may be a slip fit onto such a rounded rectangular shape. Preferably, the body 52 is sufficiently large that a passage 56 through the valve 38 does not comprise a restriction in the flowpath 32.

In one embodiment, the valve body 52 may serve to connect the tubular element 44 to the jumper tube 30 within the seal element 34, so that each of these connections is made within the seal element. In this manner, the connections 54 will be sealed against leakage and will be reinforced when the material 36 swells.

However, it should be understood that it is not necessary for the valve 38 or the connections 54 (or either of them) to be positioned within the seal element 34 in keeping with the principles of this disclosure. The connections 54 (or either of them) may comprise the connection 50 described above for providing fluid communication between the flowpath 32 and the shunt tube assembly 26.

A closure member 58 is pivotably arranged in the body 52. In the example of FIG. 10, the closure member 58 comprises an elastomer coated metal plate. An elastomer hinge 60 is secured via a metal plate 62 and a fastener 64 to the body 52.

When fluid flows in the direction indicated by arrow 66, the passage 56 is open. However, when fluid attempts to flow in the opposite direction indicated by arrow 68, the closure member 58 pivots across the passage 56 and seals it off, thereby preventing flow through the passage.

Thus, the valve 38 comprises a one-way or check valve. In the well system 10 of FIG. 1, the valves 38 would permit downward flow of the gravel slurry in the gravel packing operation, but would not permit upward flow of the slurry, or of production fluids thereafter.

Figure 11:
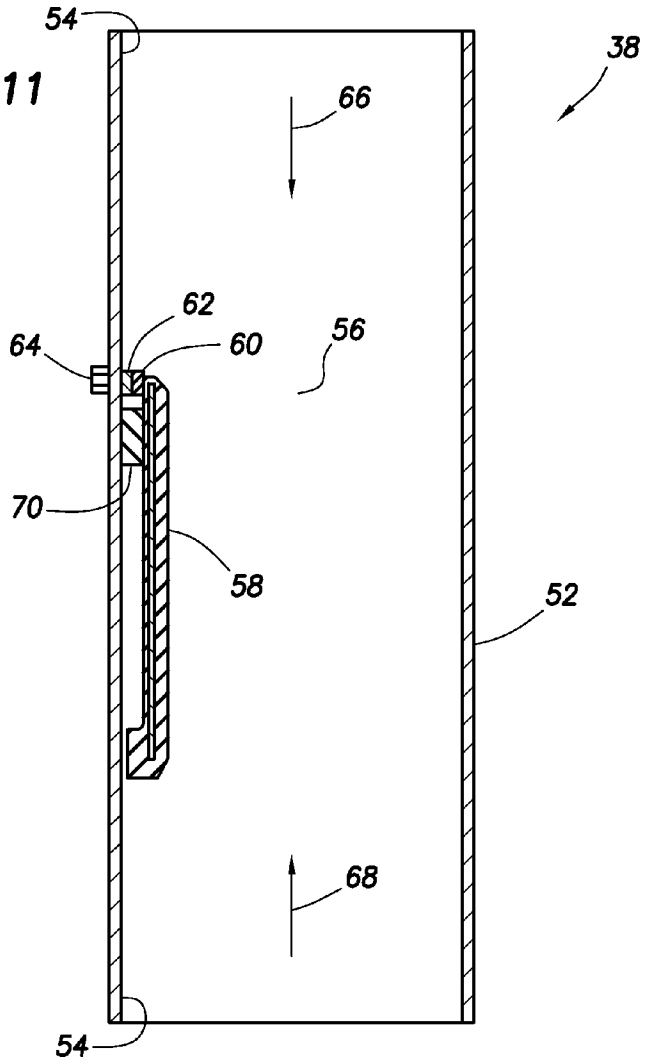
FIGS. 10-12 are enlarged scale schematic cross-sectional views of valve configurations for use in the packer assembly.

In FIG. 11, the valve 38 is configured similar in many respects to the valve of FIG. 10. However, a swellable material 70 is positioned between the closure member 58 and the body 52 on a lower side of the hinge 60.

If the material 70 is secured to both of the closure member 58 and the body 52, then the valve 38 would not comprise a one-way or check valve, but would instead permit flow in both directions 66, 68 until the material swells. When exposed to a selected fluid, the material 70 would then swell and cause the closure member 58 to pivot across the passage 56 and thereby prevent flow through the passage in both directions 66, 68.

In this manner, the flowpath 32 can be positively closed off after the gravel packing operation. For enhanced sealing capability, one of the valves 38 may be connected at each end of the flowpath 32, with the valves oriented in opposite directions, so that the closure member 58 pivots across the passage 56 in opposite directions when the material 70 swells. Swelling of the material 70 could be delayed, if desired, using the techniques and arrangements described above and in the incorporated documents.

If the material 70 is not secured to one of the closure member 58 and the body 52, then the valve 38 would comprise a one-way or check valve and would permit flow in direction 66, but not in direction 68, until the material swells. When exposed to a selected fluid, the material 70 would then swell and cause the closure member 58 to pivot across the passage 56 and thereby prevent flow through the passage in both directions 66, 68. Again, swelling of the material 70 could be delayed, if desired, using the techniques and arrangements described above and in the incorporated documents.

Figure 12:
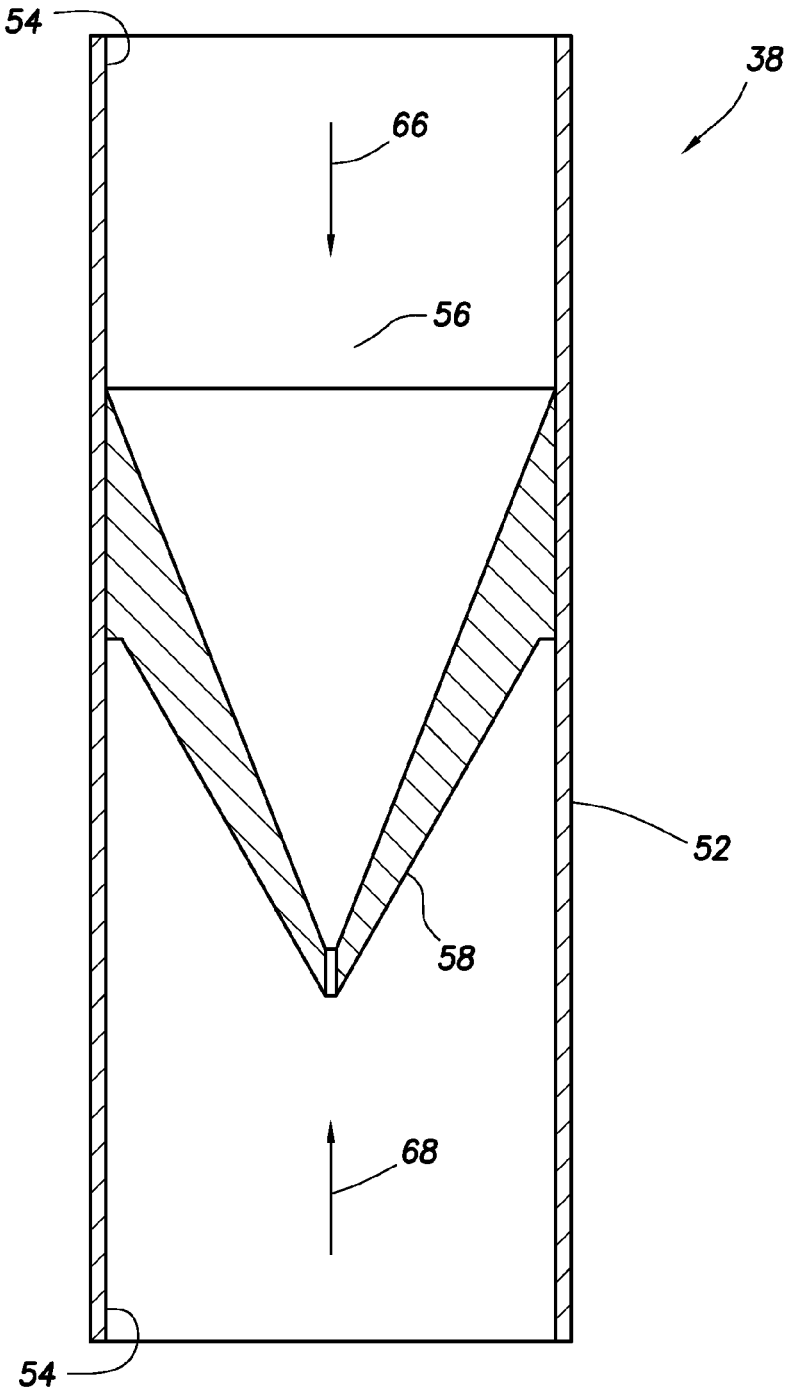

In FIG. 12, the valve 38 is similar in some respects to the valve of FIG. 10. However, instead of the closure member 58 being an elastomer coated metal plate pivotably secured with the hinge 60 to the body 52, the closure member 58 in FIG. 12 is a one-piece hollow elastomer conical structure.

The closure member 58 permits flow through the passage 56 in the direction 66, but prevents flow through the passage in the opposite direction 68. Thus, the valve 38 of FIG. 12 comprises a one-way or check valve.

It may now be fully appreciated that the above disclosure provides many advancements to the art. In particular, this disclosure provides for extending shunt tube flowpaths 32 through a swellable packer assembly 12. In various embodiments, no flow restriction is presented in the flowpaths 32 or shunt tube assemblies 26, and no restriction or reduced access is required in the interior of the base pipe 40 of the packer assembly 12. These benefits are achieved while still providing for isolation in the annulus 14 between screens 16, and providing for closing off of the flowpaths 32, after the gravel packing operation.

The above disclosure provides a well system 10 which includes a packer assembly 12 including a base pipe 40 and an annular seal element 34 which is swellable in response to contact with a selected fluid. A shunt tube flowpath 32 extends through the seal element 34 radially between the base pipe 40 and a wellbore 22 for delivery of a slurry in a gravel packing operation.

Swelling of a swellable material 36 of the seal element 34 may be delayed (for example, using swell delaying materials 72, 74). Swelling of the swellable material 36 of the seal element 34 may be delayed to a greater extent at the flowpath 32 as compared to at an outer margin of the seal element 34.

A swellable material 36 of the seal element 34 may be exposed to the flowpath 32 in the seal element. The swellable material 36 may swell and thereby prevent fluid flow through the flowpath 32 in response to presence of the selected fluid in the flowpath.

At least one valve 38 may be connected to the flowpath 32 and positioned within the seal element 34. At least first and second valves 38 may be connected to the flowpath 32 and positioned within the seal element 34, with the first valve selectively preventing flow through the flowpath in a first direction 66, and the second valve selectively preventing flow through the flowpath in a second direction 68 opposite to the first direction.

The above disclosure also provides a swellable packer assembly 12 which includes a generally tubular base pipe 40 and a swellable annular seal element 34 having a shunt tube flowpath 32 extending through a swellable material 36 of the seal element 34. At least one valve 38 may be connected to the flowpath 32, with the valve being positioned within the swellable material 36 of the seal element 34.

The at least one valve may comprise at least first and second valves 38 connected to the flowpath 32 and positioned within the swellable material 36, the first valve selectively preventing flow through the flowpath in a first direction 66, and the second valve selectively preventing flow through the flowpath in a second direction opposite 68 to the first direction.

The valve 38 may comprise a check valve. The valve 38 may include another swellable material 70 which swells and thereby displaces a closure member 58 to prevent fluid flow through the flowpath 32 in response to presence of a selected fluid in the flowpath.

Also provided by the above disclosure is a well system 10 which includes a packer assembly 12 including a base pipe 40 and an annular seal element 34 which is swellable in response to contact with a selected fluid, a shunt tube flowpath 32 extending through a swellable material 36 of the seal element 34, and a connection 50 between the flowpath 32 and a shunt tube assembly 26. The connection 50 is positioned within the swellable material 36 of the seal element 34 radially between the base pipe 40 and a wellbore 22.

A well system 10 is described above which includes a well tool 12, a shunt tube flowpath 32 extending longitudinally through the well tool 12, and at least one check valve 38 permitting flow through the flowpath 32 in one direction 66, but preventing flow through the flowpath in an opposite direction 68.

The system 10 may also include another check valve 38. The multiple check valves 38 may be longitudinally spaced apart along the well tool 12. The second check valve 38 may permit flow through the flowpath 32 in the one direction 66, but prevent flow through the flowpath in the opposite direction 68.

The check valve 38 may close, thereby preventing flow through the flowpath 32 in both directions 66, 68 in response to contact with a selected fluid.

The well tool may comprise a packer assembly 12. The packer assembly 12 may include an annular seal element 34 external to a generally tubular base pipe 40. The flowpath 32 may extend through the seal element 34 external to the base pipe 40. An annular seal element 34 of the packer assembly 12 may be swellable in response to contact with a selected fluid.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a well tool;

a shunt tube flowpath extending longitudinally through the well tool; and at least a first check valve including a swellable material and a closure member, wherein the closure member is initially open, thereby permitting flow through the flowpath in a first direction, wherein the closure member closes in response to flow through the flowpath in a second direction opposite to the first direction, thereby preventing any further flow through the flowpath in the second direction, and wherein the swellable material swells in response to contact with an activating fluid, and the closure member remains closed when the swellable material is swollen and thereby prevents fluid flow through the first check valve in both of the first and second directions.

2. The system of claim 1, further comprising a second check valve, and wherein the first and second check valves are longitudinally spaced apart along the well tool.

3. The system of claim 2, wherein the second check valve is oriented in a flow direction opposite the first check valve.

4. The system of claim 3, wherein the second check valve closes in response to contact with a selected fluid, thereby preventing flow through the flowpath in the first direction.

5. The system of claim 2, wherein the second check valve is oriented in a same flow direction as the first check valve.

6. The system of claim 5, wherein the second check valve closes in response to flow in the second direction, thereby preventing any further flow through the flowpath in the second direction.

7. The system of claim 1, wherein the well tool comprises a packer assembly.

8. The system of claim 7, wherein the packer assembly includes an annular seal element external to a generally tubular base pipe, and wherein the flowpath extends through the seal element external to the base pipe.

9. The system of claim 7, wherein an annular seal element of the packer assembly is swellable in response to contact with a selected fluid.

10. The system of claim 1, wherein the first check valve closes in response to contact with a selected fluid, thereby preventing flow through the flowpath in the second direction.

* * * * *